US007124743B2

(12) United States Patent
Gonzales, Jr. et al.

(10) Patent No.: US 7,124,743 B2
(45) Date of Patent: Oct. 24, 2006

(54) SYSTEM AND METHOD FOR STARTING SEQUENTIAL FUEL INJECTION INTERNAL COMBUSTION ENGINE

(75) Inventors: Frank Gonzales, Jr., Garden City, MI (US); Paul Mingo, Farmington Hills, MI (US); Xiaoying Zhang, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 132 days.

(21) Appl. No.: 10/904,077

(22) Filed: Oct. 22, 2004

(65) Prior Publication Data

US 2006/0086341 A1 Apr. 27, 2006

(51) Int. Cl.
*F02M 51/00* (2006.01)

(52) U.S. Cl. ..... 123/491; 701/105

(58) Field of Classification Search ..... 123/436, 123/491; 701/105

See application file for complete search history.

(56) References Cited

U.S. PATENT DOCUMENTS 4,732,122 A * 3/1988 Scarnera et al. ..... 123/491
4,998,522 A * 3/1991 Achleitner ..... 123/491
5,047,943 A 9/1991 Takahata et al.
5,390,641 A * 2/1995 Yamada et al. ..... 123/491
5,735,241 A 4/1998 Matsuura
5,954,025 A * 9/1999 Kanamaru et al. ..... 123/491
5,979,413 A 11/1999 Ohnuma et al.
6,230,687 B1 5/2001 Marca
6,253,145 B1 * 6/2001 Garrard et al. ..... 701/105
2003/0034009 A1 * 2/2003 Yuya et al. ..... 123/436

* cited by examiner

*Primary Examiner*—Erick Solis
(74) *Attorney, Agent, or Firm*—Diana D. Brehob; Bir Law, PLC

(57) ABSTRACT

A system and method for controlling an internal combustion engine during starting use position sensor information in addition to cylinder combustion information to transition from simultaneous fueling to sequential fueling by selecting a cylinder to receive a first sequential fuel injection. Embodiments include a system and method for controlling a sequentially fueled port injected internal combustion engine that contingently select a cylinder to receive a first sequential fuel injection based on position information indicating that the cylinder received a simultaneous fuel injection during its intake stroke. Engine rotational speed is monitored to detect combustion and determine which cylinder fired first. A first sequential fueling pulse is provided to the contingently selected cylinder unless a preceding cylinder in the firing order fires first.

27 Claims, 5 Drawing Sheets

SYSTEM AND METHOD FOR STARTING SEQUENTIAL FUEL INJECTION INTERNAL COMBUSTION ENGINE

DESCRIPTION

1. Field of the Invention

The present invention relates to a system and method for controlling an intake port fuel injected internal combustion engine during starting.

2. Background Art

Engine rotational position is ambiguous during engine starting until one or more associated sensors provide sufficient data to identify, with certainty, engine position, and hence piston position within each cylinder. During this period, fuel may be provided simultaneously to all cylinder intake ports with spark provided to individual cylinders or pairs of cylinders until engine position is determined with certainty and sequential fuel injection begins. Because the initial simultaneous fueling sometimes occurs before the engine position is known with certainty, it may be difficult to determine which cylinder will fire first and, therefore, which cylinder to select to initiate sequential fueling.

As shown in FIG. 5, the prior art provides an engine position signal (PIP) representing crankshaft and/or camshaft position before the information is known with certainty, as represented by the dotted PIP signal and reference numeral 510, to initiate a simultaneous injection 520. This "false" or "unsynchronized" PIP signal is used to reduce engine starting time relative to waiting for synchronization or engine position certainty at 530 to schedule the initial simultaneous fueling pulse(s). In the prior art approach illustrated in FIG. 5, the simultaneous fueling pulse occurs when intake valves for cylinder #3 and cylinder #1 are closed as represented by reference numerals 522 and 528, respectively, so cylinders #3 and #1 will not fire during the current engine cycle. The intake valves for cylinder #4 and cylinder #2 are open during at least a portion of the simultaneous fueling pulse as represented by reference numerals 524 and 526, respectively. The simultaneous fueling pulse occurs during the middle of the intake valve opening cycle for cylinder #4, so this cylinder will probably not fire during the current cycle, although under some conditions cylinder #4 may fire. The simultaneous fuel injection 520 overlaps with the beginning of the intake valve opening cycle of cylinder #2, so cylinder #2 is the most likely cylinder to fire first under most operating conditions. Because engine position information may be ambiguous when the first sequential fuel injection is scheduled, the cylinder most likely to fire first is selected to transition from simultaneous to sequential fuel injection, which is cylinder #2 in this example with the first sequential fuel injection represented by reference numeral 532. However, as noted above, under some conditions, cylinder #4 will actually fire first from the simultaneous fuel injection before cylinder #2 fires. In this situation, the first sequential fuel injection will still be provided to cylinder #2 as represented by reference numeral 532 because it was the most likely to fire first, which may result in a misfire of cylinder #4.

SUMMARY OF THE INVENTION

The present invention provides a system and method for controlling an internal combustion engine during starting that uses combustion information to supplement potentially ambiguous position sensor information to transition from simultaneous fueling to sequential fueling.

Embodiments of the present invention include a system and method for controlling a sequentially fueled port injected internal combustion engine. The system and method contingently or conditionally select a particular cylinder to receive a first sequential fuel injection based on position information that indicates that the cylinder received a simultaneous fuel injection during its intake stroke. The system and method then monitor engine rotational speed to determine which cylinder fired first. If the combustion information indicates a preceding cylinder in the firing order relative to the contingently selected cylinder fired first, the first sequential fueling pulse is provided to the preceding cylinder. Otherwise, the first sequential fueling pulse is provided to the contingently selected cylinder. In one embodiment, a crankshaft angular position sensor and a cylinder identification sensor associated with the camshaft provide engine position information used to identify which cylinder should fire first. The crankshaft position information may also be used to monitor the engine rotational speed to identify cylinder combustion based on the rotational speed or a change in the rotational speed exceeding a corresponding threshold.

The present invention provides a number of advantages. For example, the present invention reduces or eliminates misfires associated with transitioning to sequential fuel injection during starting. The present invention provides a robust fuel control system and method for selecting a cylinder to initiate sequential fueling during engine starting without requiring an additional sensor. By initiating sequential fueling with the contingently selected cylinder or the immediately preceding cylinder in the firing order, the present invention avoids over fueling that may otherwise occur when cylinders fire on residual fuel left from a previous engine shutdown, which may occur during a hot start, for example.

The above advantages and other advantages, objects, and features of the present invention will be readily apparent from the following detailed description of the preferred embodiments when taken in connection with the accompanying drawings.

DETAILED DESCRIPTION OF THE PREFERRED EMBODIMENT(S)

Figure 1:
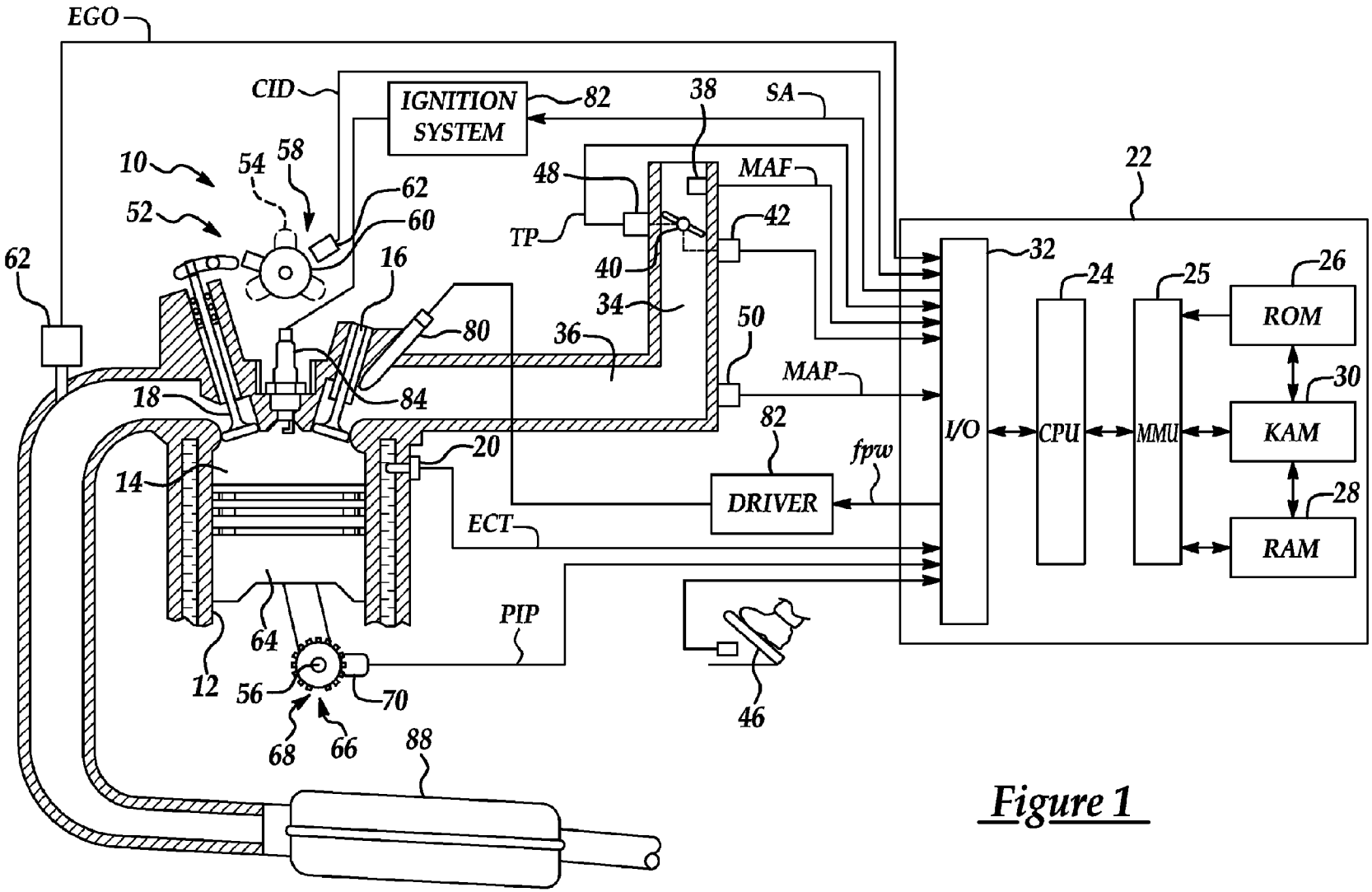
FIG. 1 is a block diagram of a representative application for a system or method for controlling an internal combustion engine according to one embodiment of the present invention.

The present invention relates to a system and method for controlling a port injected internal combustion engine during starting. The representative embodiments used to illustrate and describe the invention relate generally to a four-stroke, multi-cylinder port injected internal combustion engine. Of course, the present invention is independent of the particular engine technology or number of cylinders and may be used in a wide variety of applications with various implementations.

System 10 includes an internal combustion engine having a plurality of cylinders, represented by cylinder 12, with corresponding combustion chambers 14. As one of ordinary skill in the art will appreciate, system 10 includes various sensors and actuators to effect control of the engine. One or more sensors or actuators may be provided for each cylinder 12, or a single sensor or actuator may be provided for the engine. For example, each cylinder 12 may include four actuators that operate intake valves 16 and exhaust valves 18. However, the engine may include only a single engine coolant temperature sensor 20.

Controller 22 has a microprocessor 24, called a central processing unit (CPU), in communication with memory management unit (MMU) 25. MMU 25 controls the movement of data among the various computer readable storage media and communicates data to and from CPU 24. The computer readable storage media preferably include volatile and nonvolatile storage in read-only memory (ROM) 26, random-access memory (RAM) 28, and keep-alive memory (KAM) 30, for example. KAM 30 may be used to store various operating variables while CPU 24 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 24 in controlling the engine or vehicle into which the engine is mounted. The computer-readable storage media may also include floppy disks, CD-ROMs, hard disks, and the like. CPU 24 communicates with various sensors and actuators via an input/output (I/O) interface 32. Interface 32 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 24. Examples of items that are actuated under control by CPU 24, through I/O interface 32, are fuel injection timing, fuel injection rate, fuel injection duration, throttle valve position, spark plug ignition timing (in the event that engine 10 is a spark-ignition engine), and others. Sensors communicating input through I/O interface 32 may be indicating piston position, engine rotational speed, vehicle speed, coolant temperature, intake manifold pressure, accelerator pedal position, throttle valve position, air temperature, exhaust temperature, exhaust air to fuel ratio, exhaust component concentration, and air flow, for example. Some controller architectures do not contain an MMU 25. If no MMU 25 is employed, CPU 24 manages data and connects directly to ROM 26, RAM 28, and KAM 30. Of course, the present invention could utilize more than one CPU 24 to provide engine control and controller 22 may contain multiple ROM 26, RAM 28, and KAM 30 coupled to MMU 25 or CPU 24 depending upon the particular application.

In operation, air passes through intake 34 and is distributed to the plurality of cylinders via an intake manifold, indicated generally by reference numeral 36. System 10 preferably includes a mass airflow sensor 38 that provides a corresponding signal (MAF) to controller 22 indicative of the mass airflow. A throttle valve 40 may be used to modulate the airflow through intake 34. Throttle valve 40 is preferably electronically controlled by an appropriate actuator 42 based on a corresponding throttle position signal generated by controller 22. The throttle position signal may be generated in response to a corresponding engine output or torque requested by an operator via accelerator pedal 46. A throttle position sensor 48 provides a feedback signal (TP) to controller 22 indicative of the actual position of throttle valve 40 to implement closed loop control of throttle valve 40.

A manifold absolute pressure sensor 50 is used to provide a signal (MAP) indicative of the manifold pressure to controller 22. Air passing through intake manifold 36 enters combustion chamber 14 through appropriate control of one or more intake valves 16. Intake valves 16 and exhaust valves 18 may be controlled using a conventional camshaft arrangement, indicated generally by reference numeral 52. Camshaft arrangement 52 includes a camshaft 54 that completes one revolution per combustion or engine cycle, which requires two revolutions of crankshaft 56, such that camshaft 54 rotates at half the speed of crankshaft 56. Rotation of camshaft 54 (or controller 22 in a variable cam timing or camless engine application) controls one or more exhaust valves 18 to exhaust the combusted air/fuel mixture through an exhaust manifold. A cylinder identification sensor 58 provides a signal (CID) from which the rotational position of the camshaft can be determined, preferably providing a signal once each revolution of the camshaft or equivalently once each combustion cycle. In one embodiment, cylinder identification sensor 58 includes a sensor wheel 60 that rotates with camshaft 54 and includes a single protrusion or tooth whose rotation is detected by a Hall effect or variable reluctance sensor 62. Cylinder identification sensor 58 may be used to identify with certainty the position of a designated piston 64 within cylinder 12. The particular cylinder number and piston position may vary depending upon the particular application and implementation. In one embodiment, cylinder identification sensor 58 generates a signal (CID) for cylinder #1 at twenty-six degrees (26°) of crankshaft rotation after top center of piston 64 within cylinder 12.

Additional rotational position information for controlling the engine is provided by a crankshaft position sensor 66 that includes a toothed wheel 68 and an associated sensor 70. In one embodiment, toothed wheel 68 includes thirty-five teeth equally spaced at ten-degree (10°) intervals with a single twenty-degree gap or space referred to as a missing tooth. In one embodiment for a four-cylinder engine, the missing tooth is positioned to identify ninety degrees (90°) before top center (BTC) of cylinder #1 and cylinder #4. In combination with cylinder identification sensor 58, the missing tooth of crankshaft position sensor 66 may be used to generate a signal (PIP) used by controller 22 for fuel injection and ignition timing. In one embodiment, a dedicated integrated circuit chip (EDIS) within controller 22 is used to condition/process the raw rotational position signal generated by position sensor 66 and outputs a signal (PIP) once per cylinder per combustion cycle, i.e. for a four-cylinder engine, four PIP signals per combustion cycle are generated for use by the control logic. Depending upon the particular application, control logic within CPU 24 may have additional position information provided by sensor 66 to generate a PIP signal or equivalent, for example. Crankshaft position sensor 66 may also be used to determine engine rotational speed and to identify cylinder combustion based on an absolute, relative, or differential engine rotation speed as explained in greater detail below.

An exhaust gas oxygen sensor 62 provides a signal (EGO) to controller 22 indicative of whether the exhaust gasses are lean or rich of stoichiometry. Depending upon the particular application, sensor 62 may provide a two-state signal corresponding to a rich or lean condition, or alternatively a signal that is proportional to the stoichiometry of the exhaust gases. This signal may be used to adjust the air/fuel ratio, or control the operating mode of one or more cylinders, for example. The exhaust gas is passed through the exhaust manifold and one or more catalysts 88 before being exhausted to atmosphere.

A fuel injector 80 injects an appropriate quantity of fuel in one or more injection events for the current operating mode based on a signal (FPW) generated by controller 22 and processed by driver 82. At the appropriate time during the combustion cycle, controller 22 generates a spark signal (SA) that is processed by ignition system 82 to control spark plug 84 and initiate combustion within chamber 14. During engine starting when rotational position is unknown or ambiguous, a simultaneous fuel injection is performed in which fuel is injected to all cylinder intake ports substantially simultaneously for one or more combustion cycles with a spark signal (SA) provided to a single cylinder or a pair of cylinders. After sufficient angular or rotational information is gathered to accurately determine the position of a designated cylinder within the combustion cycle, the fueling strategy transitions to sequential fuel injection and corresponding ignition control.

As explained above, to improve engine starting performance, a PIP signal may be generated (referred to as a "false PIP") to initiate simultaneous fueling of the cylinders before the engine rotational position is known with certainty, i.e. before a CID signal is generated by camshaft position sensor 58 and before the missing tooth is identified by crankshaft position sensor 66. When sufficient rotational position information is subsequently obtained, the PIP signal is adjusted to synchronize it with the engine rotational position. Prior to synchronization of the PIP signal, it is difficult to predict which one of the two or more cylinders that received the simultaneous fuel injection during some portion of its intake stroke will fire first. Because the transition from simultaneous to sequential fueling is based on the cylinder that fires first, an error in the prediction may result in a misfire. As described in greater detail below, the present invention uses combustion information to supplement position information to reduce or eliminate this uncertainty in selecting a cylinder to begin sequential fuel injection.

Controller 22 includes software and/or hardware implementing control logic to control the engine during starting according to the present invention. In one embodiment, controller 22 selects the cylinder to begin sequential fueling based on cylinder combustion information in addition to position sensor information, with cylinder combustion determined based on engine rotational speed or acceleration detected using crankshaft position sensor 66, and engine rotational position determined based on cylinder identification sensor 58 and/or crankshaft position sensor 66.

Figure 2:
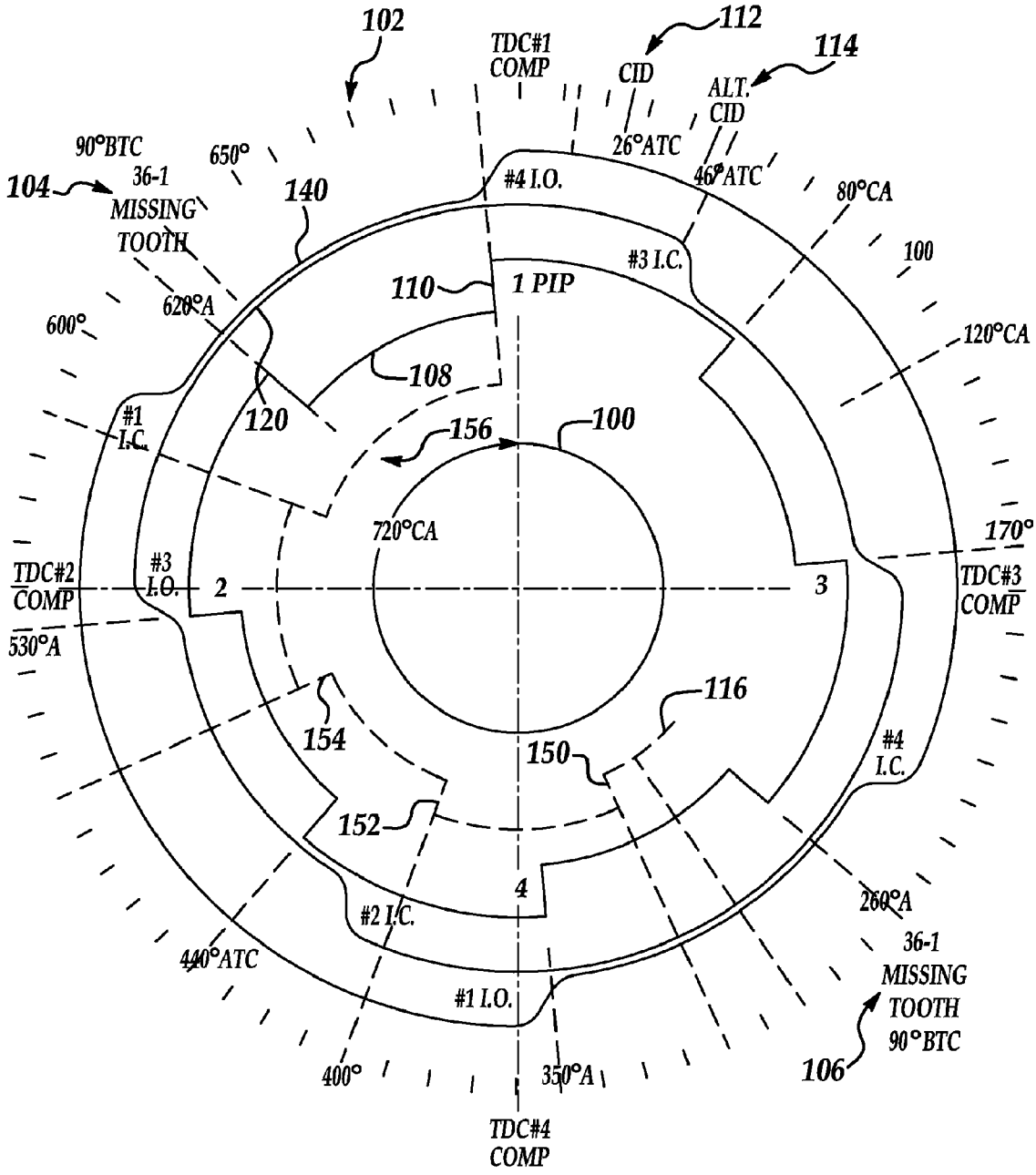
FIG. 2 is a representative timing diagram illustrating engine rotational position sensor signals relative to combustion cycle timing for a four-cylinder, four-stroke internal combustion engine used in controlling engine starting according to one embodiment of the present invention.

FIG. 2 is a representative timing diagram illustrating signals from engine rotational position sensors relative to combustion cycle timing for a four-cylinder, four-stroke internal combustion engine used in controlling engine starting according to one embodiment of the present invention. The timing diagram of FIG. 2 corresponds to one rotation of the camshaft or equivalently two rotations of the crankshaft (720° CA), indicated generally by reference numeral 100. The crankshaft position sensor provides a signal 102 every ten degrees of crankshaft rotation with the exception of a twenty-degree gap or missing tooth 104, 106, which is positioned in this embodiment at ninety degrees before top center compression (90° BTC) of cylinder #1 and cylinder #4, respectively. A synchronized profile ignition pick-up signal (PIP), indicated generally by reference numeral 108, is generated by the controller based on the signal received from the crankshaft position sensor with synchronization provided by the missing tooth. As illustrated, in this embodiment the rising edges 110 of the PIP signal occur at ten degrees before top center compression (10° BTC) of each cylinder with the firing order proceeding with cylinder #1, #3, #4, and #2, respectively. Stated differently, the rising edge of the synchronized PIP signal is generated at 170°, 350°, 530° and 710° of crank angle position.

The camshaft sensor or cylinder identification sensor provides a signal (CID) once per combustion cycle as indicated by reference numeral 112. In one embodiment, the camshaft sensor provides a signal (CID) at twenty-six degrees after top center (26° ATC) of cylinder number one. In another embodiment, the cylinder identification signal is generated at forty-six degrees after top center (46° ATC) as indicated by reference numeral 114. Opening of intake valves for cylinders #2 and #3 is generally represented by contour 120 with opening of intake valves for cylinders #1 and #4 generally illustrated by contour 140. As will be appreciated by those of ordinary skill in the art, the intake events represented in FIG. 2 are shown with short opening and closing ramps for clarity. For typical applications the valves would begin closing just after the mid-open position with actual lift profiles resembling an upside-down "V" rounded at the top.

As described above, a "false PIP" signal 116 may also be generated to improve starting performance, but is not necessarily synchronized with the engine rotational position as illustrated in FIG. 2. The "false PIP" signal 116, using a 4-cylinder engine as an example, is generated as described by the following.

Assuming the engine rotational position at the start of cranking is two-hundred-ninety degrees (290°). When the crankshaft has rotated twenty to thirty degrees (20°–30°) of engine rotation, CPU 24 generates a false PIP up-edge 150 followed by a false down-edge 152 ninety crank degrees (90°) later and then another false up-edge 154 ninety degrees (90°) after the previous down-edge and so on. It will continue in this manner until the missing tooth is identified, which in this example occurs at six-hundred-thirty degrees (630°) with missing tooth 104. If the false PIP signal is low when the missing tooth is identified as illustrated in FIG. 2 at 156, CPU 24 will hold it low and will then generate the first synchronized or true PIP up-edge 110 at eighty crank degrees (80°) from missing tooth 104. If the PIP signal were up or high when the missing tooth was identified, CPU 24 would pull it down or low and would similarly generate the first synchronized or true PIP up-edge eighty degrees (80°) after missing tooth 104. For engines with other than four cylinders, the process is the same but the number of engine crank degrees between PIP up and down edges, and the number of degrees from the missing tooth to the first accurate or true PIP up-edge will vary.

Fuel injection timing is based on the PIP signals (whether synchronized or false). Depending upon the particular application, the first simultaneous fuel injection may be delayed by one or more PIP signals (whether synchronized or false PIP signals) to assure sufficient fuel pressure is generated by the fuel pump(s) before opening the injectors. As illustrated in the example of FIG. 2, with a one-PIP fueling delay, the first simultaneous fuel injection occurs at the second PIP up-edge 154 corresponding to four hundred ninety crank degrees (490° CA). At this point, cylinder #1 intake valve(s) are partially open and may or may not induct enough fuel to fire depending upon the particular operating conditions and various other factors. However, cylinder #3 intake valve(s) are just about to open so that cylinder #3 would induct sufficient fuel and would certainly fire. After identifying missing tooth 104 and subsequently generating the first synchronized PIP up-edge 110, CPU 24 will receive the CID signal 112 that identifies cylinder #1, which can then be associated with the previous PIP up-edge 110. This information is then used to associate the preceding false PIP up-edge 154 with the beginning of the intake stroke of cylinder #3 based on the known firing. CPU 24 also knows that the simultaneous fuel injection occurred based on PIP up-edge 154.

Based on the above information, the prior art fueling strategy assumed that cylinder #3 would fire first because it received the simultaneous injection at the beginning of its intake stroke. As such sequential fueling would then be initiated on the next cycle with cylinder #3. However, due to the ambiguity of the rotational position information, the simultaneous fuel injection did not occur precisely at the beginning of the intake stroke for cylinder #3 as assumed by the CPU, but rather during the middle of the intake stroke of cylinder #1. As such, cylinder #1 may actually be the first cylinder to fire based on the simultaneous fuel injection such that the first sequential fuel injection provided to cylinder #3 rather than cylinder #1 may result in a misfire of cylinder #1.

The present inventors recognized this possibility and developed a robust system and method to accurately detect the first cylinder to fire based on both position information and combustion information. In one embodiment, combustion information is determined based on engine rotational position sensor information by monitoring the engine rotational speed and/or acceleration. Engine rotational speed or acceleration may be determined based directly or indirectly on the crankshaft position sensor signal. For example, the rotational or angular speed may be determined directly based on the frequency of the crankshaft position sensor signal, or may be determined indirectly using a signal based on or derived from the crankshaft position sensor signal, such as the PIP signal, for example. The engine rotational speed or acceleration may then be used to detect cylinder combustion by comparing the speed or acceleration to a corresponding threshold with cylinder combustion indicated if the speed or acceleration exceeds the threshold. Of course, various other sensors or methods may be employed to determine the engine rotational speed and/or acceleration and to detect cylinder combustion depending upon the particular application.

As those of ordinary skill in the art will recognize, the present invention is independent of the particular system or method used to identify combustion within a particular cylinder, or to synchronize the combustion cycle with the rotational position information provided by one or more sensors. The relationship between various combustion cycle events, such as valve operation, sensor signals, fueling, and ignition timing will vary depending upon the particular engine technology, number of cylinders, and various other application-specific parameters.

Figure 3:
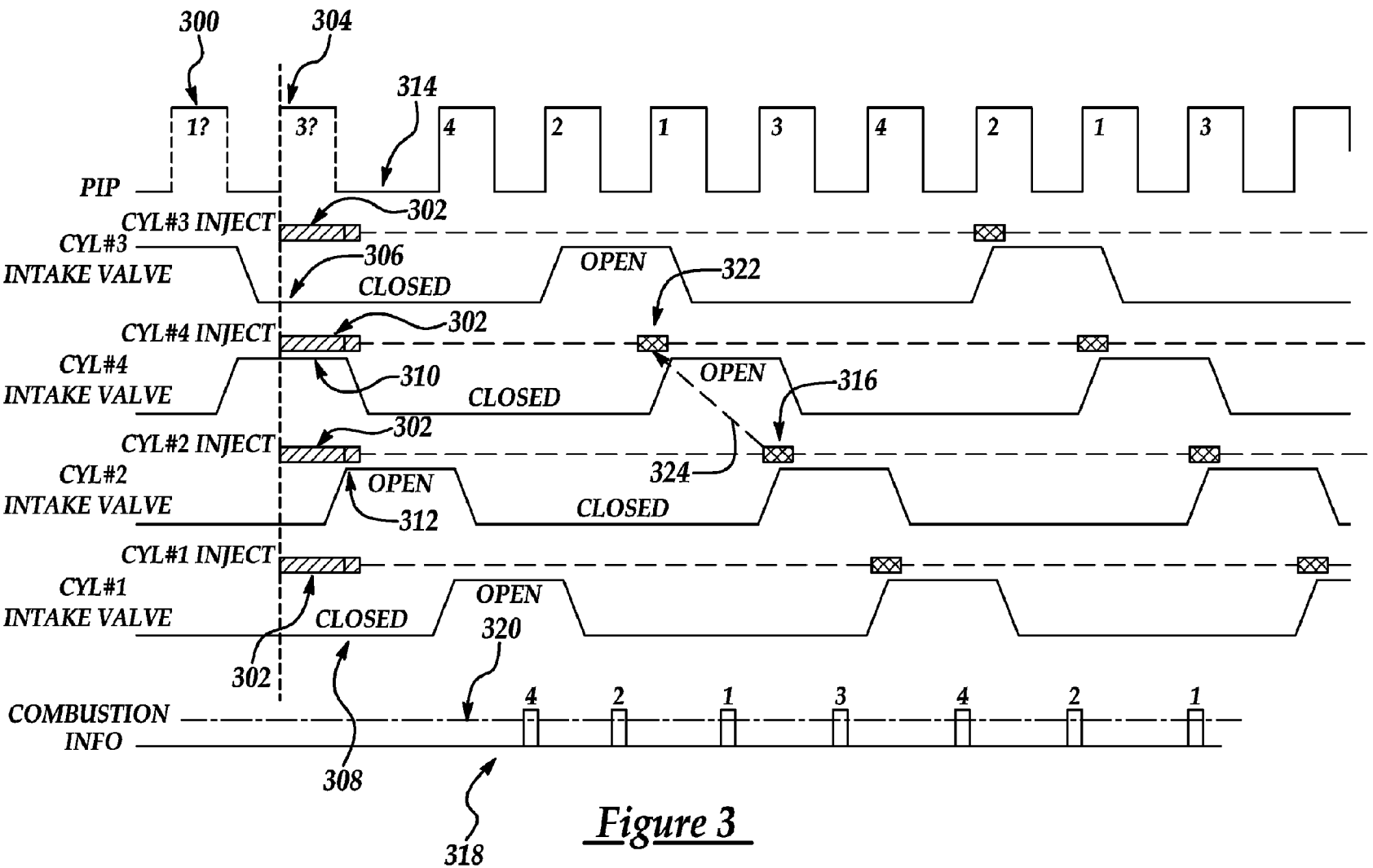
FIG. 3 is a representative timing diagram illustrating the use of combustion information to supplement potentially ambiguous engine rotational position information according to one embodiment of the present invention.

An alternative representation of a timing diagram illustrating operation of a system or method for controlling an engine during starting according to the present invention is shown in FIG. 3. The timing diagram of FIG. 3 illustrates an engine in a different rotational starting position than the diagram of FIG. 2. When engine cranking begins, an unsynchronized or false PIP is generated at 300 based on information from the crankshaft sensor but without the benefit of the "missing tooth" or CID sensor information such that the cylinder number and intake valve status is ambiguous. After a one-PIP delay to allow time to build sufficient fuel pressure, a simultaneous fuel injection 302 occurs on the up-edge of the second unsynchronized PIP signal 304.

Because the engine rotational position, and therefore intake valve positions are ambiguous at this point, the engine controller can not yet determine which cylinder intake valves were open during the simultaneous fuel injection. PIP synchronization occurs at 314 when the "missing tooth" and CID signals have been received to determine with certainty the engine rotational position, which preferably occurs sixty-eighty degrees (60°–80°) before the first true or synchronized PIP up-edge is generated depending upon the particular implementation. The engine controller is then able to determine that the simultaneous fuel injection 302 occurred with the intake valves for cylinder #3 and cylinder #1 closed as indicated at 306 and 308, respectively, but with the intake valves for cylinder #4 and cylinder #2 open as indicated at 310 and 312, respectively. Furthermore, the engine controller determines that cylinder #2 was at the beginning of its intake stroke so cylinder #2 is more likely to fire before cylinder #4, which received the simultaneous fuel injection during the middle of its intake stroke. Based on this information, the engine controller contingently selects a default cylinder (#2) to receive the first sequential fuel injection as indicated at 316.

According to the present invention, combustion information, indicated generally by reference numeral 318, is used to supplement the engine rotational information in transitioning from simultaneous to sequential fuel injection. As described above, combustion information may be provided by a dedicated sensor, but is preferably determined based on existing sensor information, such as engine rotational speed or change in rotational speed. Combustion information indicates combustion within a corresponding cylinder when it exceeds an associated threshold as represented by reference numeral 320.

In the example of FIG. 3, the combustion information indicates that, contrary to the predicted cylinder (#2) to fire first and selected as the default cylinder to receive the first sequential fuel injection, cylinder #4 actually fired first. As such, the engine controller modifies or adjusts the contingently selected default cylinder (#2) to the preceding cylinder in the firing order (#4) so that the first sequential fuel injection is provided to cylinder #4 as represented by reference numeral 322 and arrow 324.

Figure 4:
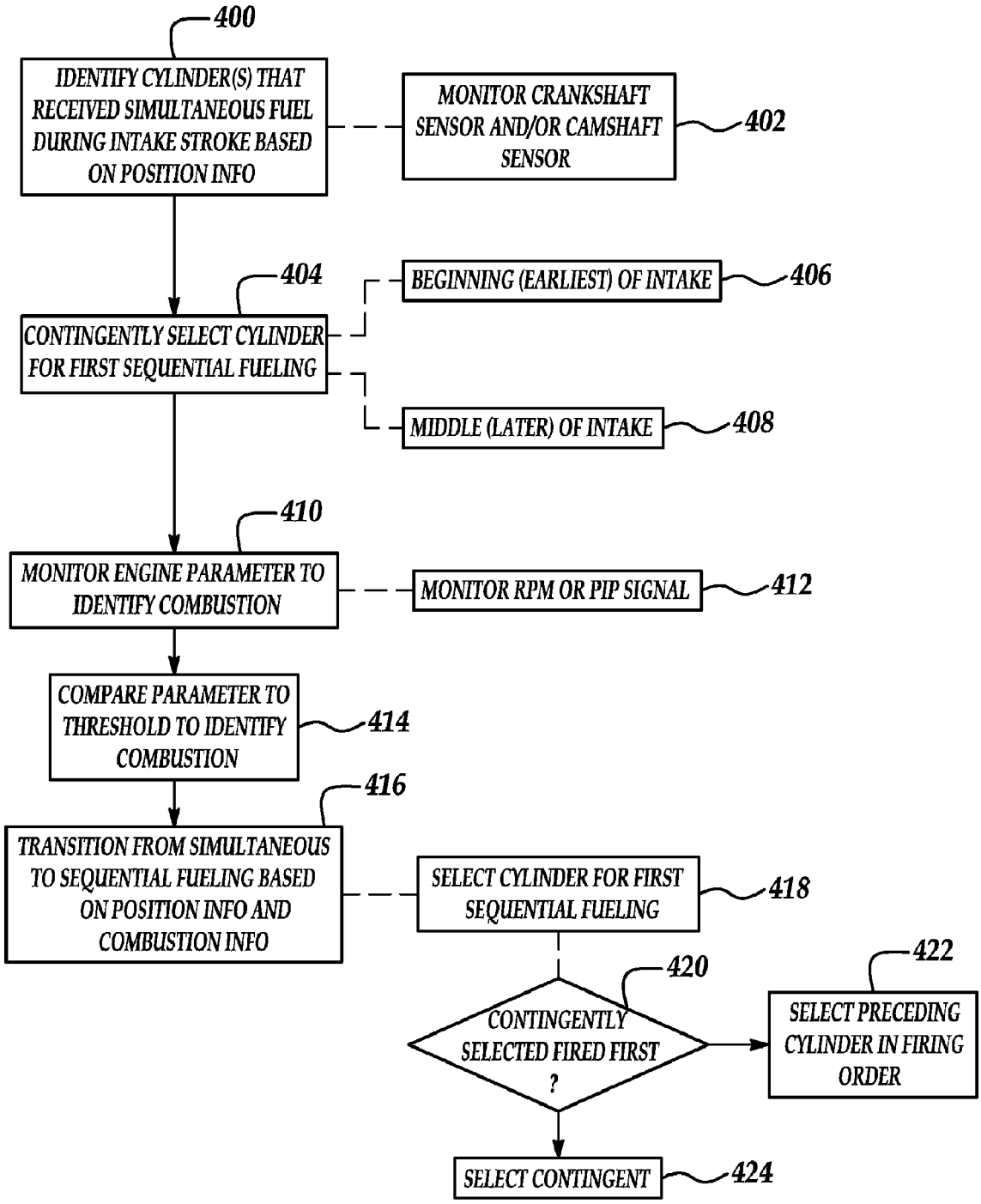
FIG. 4 is a block diagram illustrating a system or method for controlling an internal combustion engine according to one embodiment of the present invention.
Figure 5:
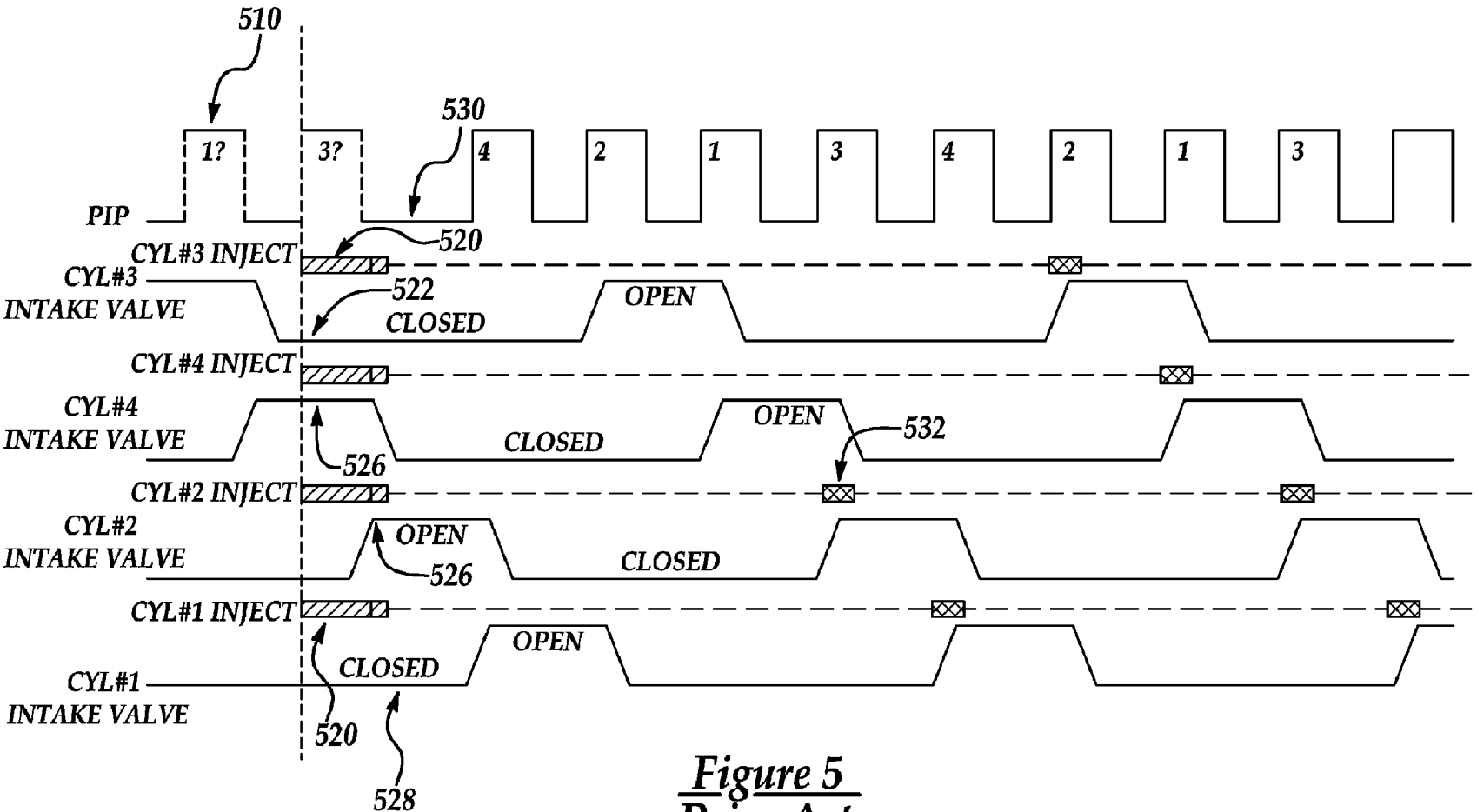
Figure 5 Prior Art
FIG. 5 is a representative timing diagram for a prior art engine control system illustrating conditions that may result in a misfire when transitioning to sequential fuel injection during starting.

A block diagram illustrating operation of representative embodiments of a system and method for controlling an internal combustion engine during starting according to the present invention is shown in FIG. 4. The diagram of FIG. 4 represents various levels of control logic for one embodiment of the present invention. As will be appreciated by one of ordinary skill in the art, the diagram of FIG. 4 may represent any of a number of known processing strategies such as event-driven, interrupt-driven, multi-tasking, multi-threading, and the like. As such, various steps or functions illustrated may be performed in the sequence illustrated, in parallel, or in some cases omitted. Although not explicitly illustrated, one of ordinary skill in the art will recognize that one or more of the illustrated steps or functions may be repeatedly performed depending upon the particular processing strategy being used. Similarly, the order of processing is not necessarily required to achieve the objects, features, and advantages of the invention, but is provided for ease of illustration and description. Preferably, the control logic is implemented in software executed by a microprocessor-based vehicle, engine, and/or powertrain controller, such as controller 22 (FIG. 1). Of course, the control logic may be implemented in software, hardware, or a combination of software and hardware in one or more controllers depending upon the particular application. When implemented in software, the control logic is preferably provided in one or more computer-readable storage media having stored data representing code or instructions executed by a computer to control the engine. The computer-readable storage medium may be any of a number of known physical devices which utilize electric, magnetic, and/or optical storage to keep executable instructions and associated calibration information, operating variables, and the like.

As illustrated in FIG. 4, a simultaneous fuel injection delivers fuel to all cylinders substantially simultaneously with one or more cylinders that receive the simultaneous fuel injection during some portion of their intake stroke identified based on position information as represented by block 400. The position information may be provided by one or more engine sensors that may include a crankshaft position sensor and/or camshaft position sensor as represented by block 402. The position information may be used to generate a derivative signal based on the position information, such as the false PIP signal described above. Alternatively, any other sensor that provides an indication of the piston position within a cylinder and the corresponding intake and/or exhaust valve position or state, e.g. open or closed, may be used to identify the cylinder or cylinders that received a simultaneous fuel injection during their intake stroke. As those of ordinary skill in the art will recognize, the number of cylinders that receive the simultaneous injection during their intake stroke will vary depending on the total number of engine cylinders.

A cylinder is contingently or conditionally selected as a default cylinder to receive the first sequential fuel injection based on the cylinder or cylinders that received the simultaneous fuel injection during their intake stroke as represented by block 404. In one embodiment for a four cylinder engine with two cylinders receiving a simultaneous fuel injection during their intake stroke, the cylinder that received the simultaneous injection at the beginning of its intake stroke, or earlier in its intake stroke than any other cylinder, is contingently selected as represented by block 406. In another embodiment of a four cylinder engine with two cylinders receiving a simultaneous injection during their intake stroke, the cylinder that received the simultaneous injection during the middle, or later in its intake stroke than at least one other cylinder, is contingently selected to receive the first sequential fueling pulse as represented by block 408.

At least one engine parameter is monitored to detect or identify combustion within a particular cylinder as represented by block 410. In one embodiment, engine rotational speed or acceleration is monitored, or alternatively a signal based on engine rotational speed or acceleration such as the PIP signal, is monitored as represented by block 412. The engine rotational speed or acceleration is then optionally compared to a corresponding threshold as represented by block 414 with combustion indicated if the engine speed or acceleration exceeds the threshold. Alternatively, the PIP signal can be monitored with a significant decrease in PIP period indicating combustion within the corresponding cylinder.

The position information and combustion information, if available, may then be used to transition from simultaneous fueling to sequential fueling as represented by block 416. In one embodiment, if the cylinder before the contingently selected cylinder fires first, then sequential fuel injection begins with that cylinder as represented by blocks 420 and 422. If the contingently selected cylinder fires first, then sequential fuel injection begins with the contingently selected or default cylinder as represented by block 424. Depending upon the particular application and implementation, the cylinder ultimately selected to receive the first sequential fueling pulse may differ by more than one cylinder in the firing order relative to the contingently selected cylinder.

As those of ordinary skill in the art will appreciate, the present invention reduces or eliminates misfires associated with transitioning to sequential fuel injection during starting by providing a robust strategy for selecting a cylinder to initiate sequential fueling during engine starting. By contingently selecting a particular cylinder or the immediately preceding cylinder in the firing order, the present invention avoids over fueling that may otherwise occur when cylinders fire on fuel from a previous engine shutdown, which may occur during a hot start, for example.

While the best mode for carrying out the invention has been described in detail, those familiar with the art to which this invention relates will recognize various alternative designs and embodiments for practicing the invention as defined by the following claims.

What is claimed is:

1. A method for controlling a sequential fuel injection multiple cylinder internal combustion engine during starting, the method comprising:

monitoring rotational position of at least one engine component;

monitoring at least one engine parameter to identify a first cylinder to begin combustion; and transitioning from simultaneous fueling to sequential fueling based on the rotational position of the at least one engine component and the first cylinder to begin combustion.

2. The method of claim 1 wherein the step of monitoring rotational position comprises monitoring rotational position of an engine crankshaft.

3. The method of claim 1 wherein the step of monitoring rotational position comprises monitoring rotational position of an engine camshaft.

4. The method of claim 1 wherein the step of monitoring rotational position comprises monitoring rotational position of an engine crankshaft and an engine camshaft.

5. The method of claim 1 wherein the step of monitoring at least one engine parameter comprises monitoring engine rotational speed.

6. The method of claim 1 wherein the step of monitoring at least one engine parameter comprises:

monitoring engine rotational speed;

comparing engine rotational speed to a threshold; and determining cylinder combustion based on the engine rotational speed exceeding the threshold.

7. The method of claim 1 wherein the step of transitioning from simultaneous fueling to sequential fueling comprises:

identifying a cylinder that received a simultaneous fueling pulse during an intake stroke; and beginning sequential fueling with a preceding cylinder in the firing order if the preceding cylinder was the first cylinder to begin combustion and beginning sequential fueling with the cylinder that received the simultaneous fueling pulse during its intake stroke otherwise.

8. The method of claim 7 wherein the step of beginning sequential fueling comprises beginning sequential fueling with an immediately preceding cylinder in the firing order if any preceding cylinder in the firing order begins combustion before the cylinder that received the simultaneous fueling pulse during its intake stroke.

9. The method of claim 7 wherein the step of identifying a cylinder comprises identifying a cylinder that received the simultaneous fueling pulse at the beginning of its intake stroke.

10. A method for controlling a multiple cylinder internal combustion engine, the method comprising:

selecting a default cylinder to receive a first sequential fuel injection based on said cylinder receiving a simultaneous fuel injection during an intake stroke;

monitoring engine rotational speed to determine which cylinder fired first;

providing a first sequential fueling pulse to the default cylinder unless a preceding cylinder in the firing order fired first.

11. The method of claim 10 wherein the step of selecting a default cylinder comprises selecting the default cylinder based on said cylinder receiving a simultaneous fuel injection earlier in its intake stroke than any other cylinder receiving a simultaneous fuel injection during its intake stroke.

12. The method of claim 10 wherein the step of selecting a default cylinder comprises selecting the default cylinder based on said cylinder receiving a simultaneous fuel injection during a middle portion of its intake stroke.

13. The method of claim 10 wherein the step of providing a first sequential fueling pulse comprises providing a first sequential fueling pulse to an immediately preceding cylinder if any preceding cylinders fired first.

14. The method of claim 10 wherein the step of monitoring engine rotational speed comprises:

comparing engine rotational speed associated with each cylinder to a threshold; and determining a cylinder fired when rotational speed exceeds the threshold.

15. A system for controlling a sequential fuel injection multiple cylinder internal combustion engine during starting, the system comprising:

a sensor for providing a signal indicative of rotational position of at least one engine component; and a controller in communication with the sensor, the controller monitoring at least one engine parameter to identify a first cylinder to begin combustion and transitioning from simultaneous fueling to sequential fueling based on the rotational position of the at least one engine component and the first cylinder to begin combustion.

16. The system of claim 15 wherein the sensor provides a signal indicative of rotational position of an engine crankshaft and/or camshaft.

17. The system of claim 15 wherein the controller monitors engine rotational speed to identify the first cylinder to begin combustion.

18. The system of claim 15 wherein the controller monitors engine rotational speed and compares the engine rotational speed to a threshold to identify the first cylinder to being combustion based on the engine rotational speed exceeding the threshold.

19. The system of claim 15 wherein the controller transitions from simultaneous fueling to sequential fueling by identifying a default cylinder that received a simultaneous fueling pulse during an intake stroke and beginning sequential fueling with the default cylinder unless a preceding cylinder in the firing order fired first.

20. The system of claim 19 wherein the controller begins sequential fueling with an immediately preceding cylinder in the firing order if any preceding cylinder in the firing order fired before the default cylinder.

21. The system of claim 15 wherein the controller transitions from simultaneous fueling to sequential fueling by identifying a default cylinder that received a simultaneous fueling pulse at the beginning of its intake stroke and beginning sequential fueling with the default cylinder if that cylinder was the first cylinder to begin combustion, or with an immediately preceding cylinder in the firing order if any preceding cylinder in the firing order was the first cylinder to begin combustion.

22. A computer readable storage medium having stored data representing instructions executable by a computer to control a multiple cylinder internal combustion engine during starting, the computer readable storage medium comprising:

instructions for contingently selecting a cylinder to receive a first sequential fuel injection based on said cylinder receiving a simultaneous fuel injection during an intake stroke;

instructions for monitoring engine rotational speed to determine which cylinder fired first; and instructions for providing a first sequential fueling pulse to the contingently selected cylinder unless a preceding cylinder in the firing order fired first.

23. The computer readable storage medium of claim 22 wherein the instructions for contingently selecting a cylinder comprise instructions for contingently selecting the cylinder based on the cylinder receiving a simultaneous fuel injection earlier in its intake stroke than any other cylinder receiving a simultaneous fuel injection during its respective intake stroke.

24. The computer readable storage medium of claim 22 wherein the instructions for contingently selecting a cylinder comprise instructions for contingently selecting the cylinder based on the cylinder receiving a simultaneous fuel injection during a middle portion of its intake stroke.

25. The computer readable storage medium of claim 22 wherein the instructions for providing a first sequential fueling pulse comprise instructions for providing a first sequential fueling pulse to the contingently selected cylinder if the contingently selected cylinder fired first, or to an immediately preceding cylinder in the firing order if any preceding cylinder in the firing order fired first.

26. The computer readable storage medium of claim 22 wherein the instructions for monitoring engine rotational speed comprise:

instructions for comparing engine rotational speed associated with each cylinder to a threshold; and instructions for determining the cylinder fired when the rotational speed exceeds the threshold.

27. The computer readable storage medium of claim 22 wherein the medium comprises a computer chip.

* * * * *